US005205476A

United States Patent [19]

Sorenson

[11] Patent Number: 5,205,476

[45] Date of Patent: Apr. 27, 1993

[54] CLAMSHELL CARTON HAVING AN IMPROVED LATCHING MECHANISM

[75] Inventor: John F. Sorenson, Naperville, Ill.

[73] Assignee: Perseco Division of The HAVI Group LP, Oak Brook, Ill.

[21] Appl. No.: 898,027

[22] Filed: Jun. 12, 1992

[51] Int. Cl.[5] ..... B65D 5/66; B65D 43/16

[52] U.S. Cl. ..... 229/114; 229/148; 229/906

[58] Field of Search ..... 229/114, 125.29, 146, 229/148, 149, 150, 902, 906; 220/4.23, 4.24, 4.25

[56] References Cited

U.S. PATENT DOCUMENTS

| | | | |
|---|---|---|---|
| 329,134 | 10/1885 | Brotz | 229/146 |
| 708,288 | 9/1902 | Winslow | 229/114 |
| 1,329,531 | 2/1920 | Kitt | 229/120 |
| 1,771,760 | 7/1930 | MacLellan | 229/152 |
| 1,839,752 | 1/1932 | Fogg | 229/115 |
| 2,247,870 | 7/1941 | Chalmers | 229/146 |
| 2,544,565 | 3/1951 | Phillips . | |
| 2,982,465 | 5/1961 | Fallert | 229/148 |
| 3,163,344 | 12/1964 | Tunick | 229/906 |
| 3,190,535 | 6/1965 | Nute | 229/126 |
| 3,330,467 | 7/1967 | Johnson | 229/126 |
| 3,343,660 | 9/1967 | Bailey | 229/114 |
| 3,410,475 | 11/1968 | Wagner | 229/125.29 |
| 3,684,159 | 8/1972 | Wolfe | 229/148 |
| 4,230,261 | 10/1980 | Austin | 229/114 |
| 4,232,816 | 11/1980 | Johnson et al. | 229/114 |
| 4,245,773 | 1/1981 | Stollberg | 229/DIG. 11 |
| 4,254,862 | 3/1981 | Barratt . | |
| 4,266,713 | 5/1981 | Maroszek | 229/114 |
| 4,304,353 | 12/1981 | Stollberg | 229/126 |
| 4,389,013 | 6/1983 | Hall et al. . | |
| 4,413,726 | 11/1983 | Davidson | 229/45.13 |
| 4,431,128 | 2/1984 | Dirico | 229/146 |
| 4,570,845 | 2/1986 | Hall | 229/146 |
| 4,792,085 | 12/1988 | Waring et al. | 229/114 |
| 4,856,707 | 8/1989 | Lorenz | 229/114 |
| 4,877,178 | 10/1989 | Eisman | 229/148 |
| 4,909,432 | 3/1990 | Nagata | 229/137 |
| 5,037,026 | 8/1991 | Hanko | 229/150 |
| 5,039,003 | 8/1991 | Gordon et al. | 229/114 |
| 5,058,803 | 10/1991 | Gulliver | 229/148 |
| 5,098,013 | 3/1992 | France et al. | 229/115 |

OTHER PUBLICATIONS 24 photographs of prior art boxes, Exact dates unknown.

*Primary Examiner*—Gary E. Elkins

*Attorney, Agent, or Firm*—Willian, Brinks, Olds, Hofer, Gilson & Lione

[57] ABSTRACT

A paperboard clamshell carton includes a tray and a cover, hingedly connected and latched in the closed position by cooperating latching members. Detents, extending forwardly from adjacent the upper corners of the front wall of the tray, and detent engaging slots and tabs in the cover, located adjacent the lower corners of the front wall of the cover, releasably engage when the cover is folded shut over the tray. The forwardly extending detents are of double thickness, being formed by overlapped extensions of the glue flaps and side walls of the tray.

13 Claims, 2 Drawing Sheets

Fig. 1
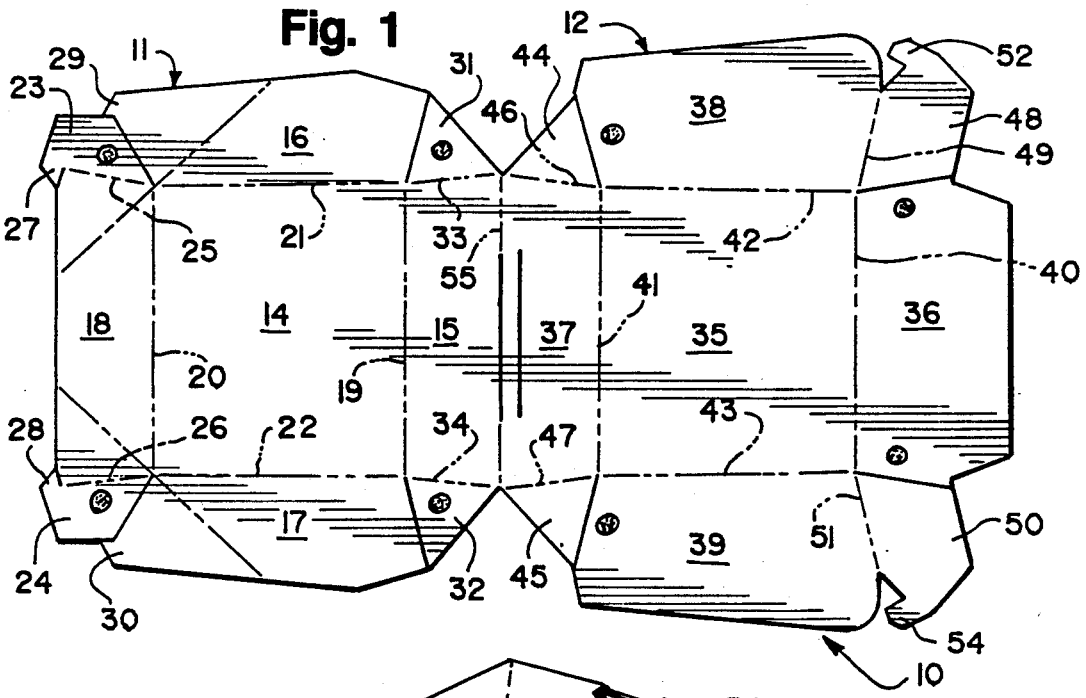
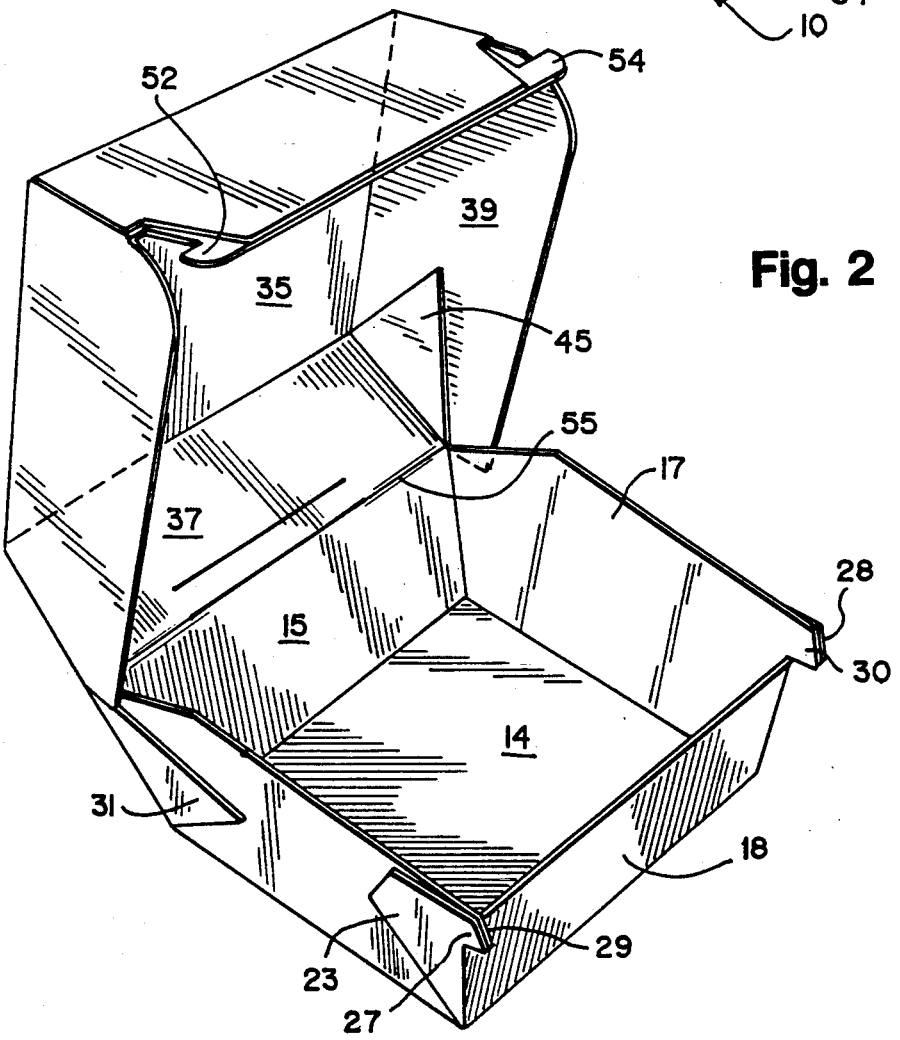
Fig. 2

CLAMSHELL CARTON HAVING AN IMPROVED LATCHING MECHANISM

FIELD OF THE INVENTION

This invention generally relates to double cavity "clamshell" containers such as those used in the packaging of hamburgers and other food products. More specifically, the invention concerns an improved latching mechanism for clamshell cartons fabricated from folded paperboard, boxboard or corrugated board.

BACKGROUND OF THE INVENTION

In fast service and carry-out food businesses, it is necessary to package food products in containers which are inexpensive, easy to ship and store, and convenient to use for the retailer and the consumer. When assembled and filled with food products, such containers must be easy to close and open, and yet they must remain shut in transport from the food counter to a table or other carry out location. It is also important, in the design and construction of such containers, to take into account environmental aspects of their use.

One form of packaging which has addressed these concerns, and has met with acceptance, is a carton comprised of a joined tray and cover with integral latching means which can be readily formed from a cut and scored blank. The cut and scored blank is made from paperboard, boxboard or corrugated board. When partially folded and glued, the blank forms a hingedly connected tray and cover, each in the form of a truncated pyramid. Such partially folded cartons can be shipped and stored in nested condition. In use, various food products, such as hamburgers, chicken pieces, pizza slices and the like, are placed in the tray portion of the partially folded carton, and the cover portion is folded over the tray portion and latched thereto at a location opposite the fold or hinge in the back panel of the carton. Such double cavity, folded tray and cover, cartons are referred to a clamshell cartons.

The design of a suitable latching mechanism for such clamshell cartons has been an object of prior art efforts. The latching mechanism must do more than simply keep the carton closed. It must be foolproof, simple and quick to use, positive and secure in its engagement, and so designed that it will not be prone to damage during transportation of the nested cartons or while being handled by restaurant crew persons or patrons.

A generally accepted prior art clamshell carton which features integral latching means is disclosed, for example, in U.S. Pat. No. 4,877,178, issued Oct. 31, 1989 to Dopaco, Inc. as assignee. In the Dopaco carton, two primary detents extend forwardly from slightly above the front wall of the tray portion. The detents are minimal in size and are double laminated during carton fabrication for additional stiffness, which enhances their performance and durability. Upon closing, the detents engage corresponding, triangular-shaped slots in each of the forward cover glue flaps.

While providing a tight and secure fit of the carton portions, the Dopaco latching mechanism has proven to be difficult to open. The natural tendency for the customer has been to pull on the center of the overhanging front panel of the cover portion to open the carton. However, this action draws the outside corners of the triangular-shaped slots into contact with the tray detents, preventing their release. Alternatively, the user can work with each corner of the carton to free the detents; this has proven cumbersome and equally ineffective. Furthermore, the triangular flaps that remain after the cover flap slots are cut in the Dopaco carton do not always pop out when the clamshell is formed and, thus, have been known to interfere with and delay closing of the carton.

Other prior art clamshell cartons have used cover engagement hooks formed from the front panel or side panels of the carton cover. The engagement hooks usually extend beyond the width or length of the carton, and suffer the disadvantage of being subject to damage during shipping and handling.

Accordingly, it is a primary object of the present invention to provide a clamshell carton having an improved latching means, which is simpler and more reliable in use.

SUMMARY OF THE INVENTION

The above and other objects are realized in the clamshell carton of the present invention, wherein a Dopaco-type container is modified by the elimination of the two interfering flaps and the substitution of sidewise projecting engagement tabs for the walled Dopaco detent receiving slots. The engagement tabs are positioned substantially inboard toward the center of the carton, and are more flexible and consequently less restrictive than the prior art corner slot design. Moreover, the tray detents are held captive by the triangular-shaped, partially walled slot cut out of each of the forward cover glue flaps. The modifications of the present invention, described in greater detail below, have resulted in a more forgiving and more responsive latching mechanism without detracting from any of the advantages inherent in the original Dopaco design.

A principal advantage of the new latching mechanism is that its component parts are readily visible and, therefor, their manner of operation can be perceived easily. If a customer endeavors to open the carton by pulling outwardly and upwardly on the front panel of the cover, the cut-away corners of the cover will permit the sidewise projecting engagement tabs to flex and draw away from engaging contact with the latching detents in the tray portion of the carton.

In accordance with the present invention, a clamshell carton having a tray and cover is locked in the closed position by means of a pair of double-walled detents extending forwardly and above the front wall of the tray. The double-walled detents are formed by overlapping extensions of the glue flaps and the side walls of the trays. Sidewise projecting tabs, inboard toward the center of the carton, are formed in the forward glue flaps of the cover and releasably engage the tray detents to latch the cover to the tray in the closed position. The full nature of the invention will be understood from the accompanying drawings and the following description and claims.

BRIEF DESCRIPTION OF THE DRAWINGS

FIG. 1 is a top plan view of a stamped and scored paperboard blank for forming the clamshell embodiment of the invention illustrated in FIGS. 2–4.

FIG. 2 is a perspective view showing the blank of FIG. 1 assembled and in the open position.

DETAILED DESCRIPTION OF THE PREFERRED EMBODIMENT

Figure 3:
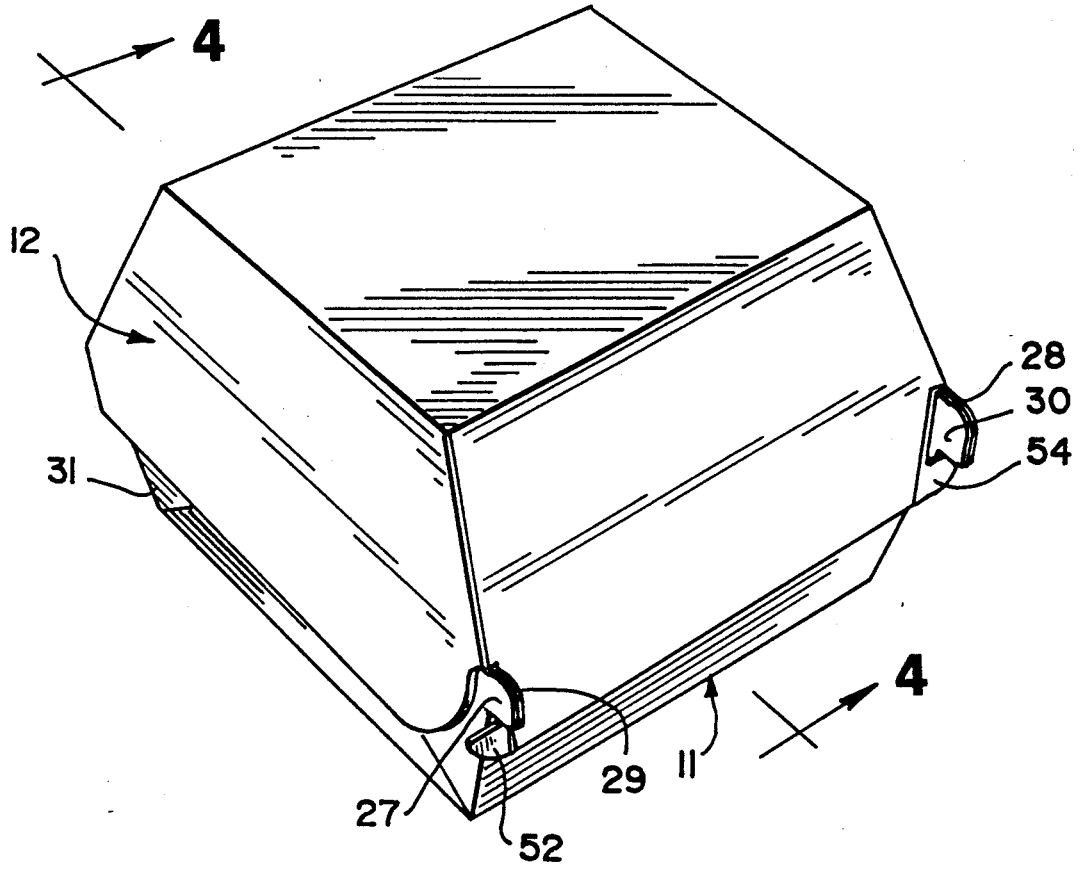
FIG. 3 is a perspective view showing the carton of FIG. 2 in a closed position.

Referring now in general to the drawings and in particular to FIGS. 1–4, the novel clamshell carton of this invention is formed of a unitary blank 10 comprising a bottom tray-forming section 1? and a top cover-forming section 12. Fold lines are shown as dashed lines while cut lines are shown as heavy solid lines.

Tray section 11 comprises a bottom rectangular panel 14, a rear wall panel 15, similar side walls 16, 17, and a front wall 18. Rear and front walls 15, 18 are connected to panel 14 along fold lines 19, 20, respectively. Side walls 16 and 17 are connected to panel 14 along fold lines 21, 22, respectively. A pair of front wall glue flaps 23, 24 are connected to opposite ends of front wall 18 along fold lines 25, 26, respectively.

A pair of latching detents 27, 28 are formed in glue flaps 23, 24, respectively, to project forwardly of front wall 18. A pair of locking detents 29, 30 are formed on side walls 16, 17, respectively, to extend outwardly thereof. As will be explained in connection with FIG. 2, detents 27, 28 and 29, 30 overlap each other in the assembled position to form sturdy, double thickness latching detents.

The cover 12 comprises a top central panel 35 connected to front cover wall 36, rear cover wall 37, and side walls 38, 39 by means of fold lines 40, 41, 42 and 43, respectively. The use of "front" and "rear" is based on the location in the assembled carton. A pair of cover rear wall glue flaps 44, 45 are connected to opposite sides of rear wall 37 along fold lines 46, 47 respectively. A glue flap 48 is connected to side wall 38 along fold line 49. A similar glue flap 50 is connected to side wall 39 along fold line 51.

A detent engaging tab 52 is cut into a section of glue flap 48. The tab 52 is formed by notching out a section along the solid cut line. A similar detent engaging tab 54 is cut into glue flap 50. The cutouts in glue flaps 48 and 50 are such that, when the carton is assembled, detent engaging tabs 52 and 54 will each form the base of a triangular-shaped slot which is open toward the outside of the carton. Thus, tabs 52 and 54 will project sidewise from the center of the carton.

A slotted fold line 55 forms a hinge between rear walls 15 and 37 of the tray and cover to form a hinged clamshell carton.

The cut in rear wall 37 and the cut along fold line 55, both shown in FIG. 1, are not part of the present invention. Rather, the cuts are part of an anti-buckling feature disclosed and claimed in commonly owned and pending Application Ser. No. 07/898,026, filed Jun. 12, 1992, the disclosure of which is incorporated herein by reference.

The circular dots situated at various locations on blank 10 represent glue deposits which are spread and join the various parts together; however, other joining means such as heat sealing may also be employed. As shown in FIG. 2, it has been found desirable to adhere glue flaps 23, 24, 31 and 32 to the outside of the tray walls. This is so the flaps do not act as a wick for food oils and other liquids which may be present in the assembled and filled carton.

The assembled carton is shown in FIG. 2 in an open position. Note the open truncated pyramid shape of the tray and cover. This construction enables easy nesting of a stack of cartons. The detents 27, 29 and 28, 30 can be seen projecting forwardly of front tray panel 18 on an upper portion thereof. Having the detents at this location increases the volume of the container in comparison with prior art constructions. Also, the double thickness detent construction increases the resistance of the carton to deformation when filled cartons are stacked. Detent engaging tabs 52 and 54 can be seen adjacent an upper portion of front wall 36, projecting sidewise therefrom but still inboard with respect to the carton side walls.

FIG. 3 shows the carton in a closed position. The truncated pyramidal-shaped top cover 12 extends over the smaller truncated pyramidal-shaped tray 11 to form a closed carton. The cover is latched to the tray when detent engaging tabs 52 and 54 ride over the latching detents in the front tray panel and are captured thereby.

Figure 4:
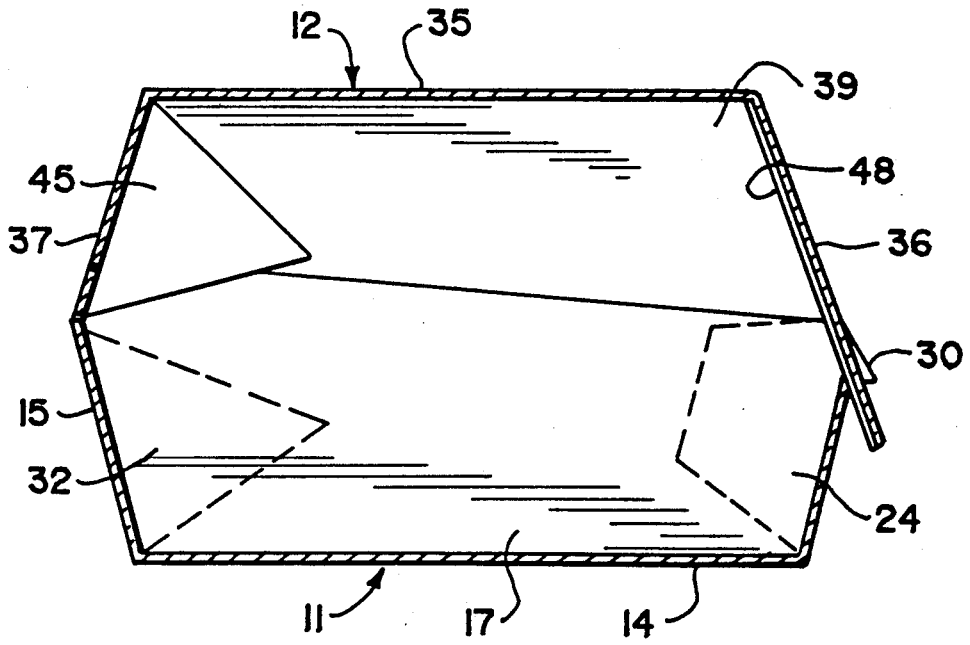
FIG. 4 is a cross-sectional view taken along the line 4—4 of FIG. 3.

FIG. 4 is a view from the inside of the closed container. Detent 30, which is part of side wall 17 is shown projecting slightly forward of detent engaging tab 54 and front cover wall 36.

The carton of the present invention is easily opened by pulling upward on the center of the overhanging front panel of the cover. Alternatively, projecting tabs 52 and 54 can be bent away from the carton, and the cover easily lifted. Significantly, the customer can easily view the latching components and readily determine a quick and efficient way to open the carton. Moreover, the cantilevered tabs 52 and 54 are sufficiently flexible to accommodate different ways of opening the carton.

It will be appreciated that the detents and corresponding detent engaging tabs can be switched in terms of their placement on the tray and cover portions of the carton, and that they can be cut to shapes other than the ones shown in the Figures. Moreover, the present inventions may be utilized in connection with different sizes and types of paperboard cartons (e.g., for hamburgers, chicken pieces, pizza and so on). It is not intended to limit the present invention to the details of the illustration or terms of description of the preferred embodiments shown above. It will be appreciated by those skilled in the art that various modifications and alterations may be made within the scope and spirit of the present invention.

I claim:

1. A clamshell carton having a tray, a cover fitting over said tray, a fold line hinge connecting said tray and cover and means for latching the cover and tray in a closed position, said latching means comprising:

double wall detents projecting forwardly above the front wall of said tray; and cooperating slot and cantilevered tab pairs in said cover for releasably engaging said double wall detents.

2. A carton according to claim 1, wherein said double wall detents in said tray are located generally adjacent upper corners of said tray front wall and said slot and cantilevered tab pairs are located generally adjacent lower corners of said front wall of said cover.

3. A carton according to claim 2, wherein each of said tabs of said slot and cantilevered tab pairs has a free end projecting generally away from the other of said tabs.

4. A carton according to claim 3, wherein said cover has said walls that extend outwardly beyond said free end of each of said tabs when said carton is closed.

5. A carton according to claim 3, wherein each of said slots of said slot and cantilevered tab pairs is generally triangular in shape, having a bottom portion defined by said cantilevered tab and a generally open portion adjacent said free end of said tab.

6. A carton formed from a unitary blank of cut and foldable paperboard comprising:

a tray, a cover fitting over said tray, and a fold line hinge connecting said tray and cover;

said tray comprising a bottom panel, two side walls, a front wall and a rear wall, said front and rear walls each having two glue flaps, each of said glue flaps being adhered to an end of one of said side walls, each of said glue flaps on said front wall having a detent in an upper portion of said front wall extending forwardly and above said front wall, each of said side walls having a detent in an upper portion thereof extending forwardly and above said front wall, each of said detents on each of said glue flaps on said front wall and each of said detents on each of said side walls being in overlapped joined relation to form a pair of double thickness detents; and said cover comprising a top panel, two side walls, a rear wall and a front wall, said front wall having both a slot and a cantilevered detent engaging tab adjacent each end portion thereof;

said cover slots and detent engaging tabs releasably engaging said pair of tray detents when said cover is closed to latch said cover to said tray.

7. A carton according to claim 6, wherein each said tray glue is folded over and adhered to an outside portion of said tray side walls.

8. A carton according to claim 6, wherein said cover slots and cantilevered detent engaging tabs are formed in said cover front wall glue flaps.

9. A carton according to claim 6, wherein said cover rear wall has two glue flaps, each of said glue flaps being adhered to an adjoining end of one of said cover side walls.

10. A carton according to claim 6, wherein each of said cantilevered detent engaging tabs projects generally away from the other and is generally perpendicular to an adjacent cover side wall.

11. A carton according to claim 10, wherein said cover side walls extend outwardly beyond the ends of said centilevered detent engaging tabs when said carton is closed.

12. A carton according to claim 10, wherein each said slot is generally triangular in shape, having a bottom portion defined by said cantilevered detent engaging tab and a generally open portion adjacent the free end of said cantilevered detent engaging tab.

13. A carton formed from a unitary blank of cut and foldable paperboard comprising:

a tray, a cover fitting over said tray, and a fold line hinge connecting said tray and cover;

said tray comprising a bottom panel, two side walls, a front wall and a rear wall, said front and rear walls each having two glue flaps, each of said glue flaps being adhered to an end of one of said side walls, each of said glue flaps on said front wall having a detent in an upper portion thereof extending forwardly and above said front wall, each of said side walls having a detent in an upper portion thereof extending forwardly and above said front wall, each of said detents on each of said glue flaps on said front wall and each of said detents on each of said side walls being in overlapped joined relation to form a pair of double thickness detents; and said cover comprising a top panel, two side walls, a rear wall, a front wall, generally triangular-shaped slots adjacent lower corners of said cover front wall and cantilevered detent engaging tabs adjacent said slots and projecting generally away from each other and generally perpendicular to said cover side walls adjacent thereto;

said cover slots and cantilevered detent engaging tabs releasably engaging said pair of tray detents when said cover is closed to latch said cover to said tray.

* * * * *